United States Patent [19]

Eftefield et al.

[11] Patent Number: 4,867,253

[45] Date of Patent: Sep. 19, 1989

[54] DAMPENER FOR IMPACTING MECHANISM

[75] Inventors: Larry G. Eftefield, Edelstein; Elmer B. Phelps, Creve Coeur, both of Ill.

[73] Assignee: Caterpillar Inc., Peoria, Ill.

[21] Appl. No.: 257,608

[22] Filed: Oct. 14, 1988

[51] Int. Cl.[4] ..... B25D 17/24

[52] U.S. Cl. ..... 173/124; 173/139; 267/137

[58] Field of Search ..... 173/119, 121, 124, 139; 267/136, 137, 140, 141, 153, 182

[56] References Cited

U.S. PATENT DOCUMENTS 3,358,778 12/1967 Ferwerda ..... 173/119
4,785,893 11/1988 Kistner ..... 173/119

FOREIGN PATENT DOCUMENTS

PCT/US86/-
02760 12/1986 PCT Int'l Appl. .
WO87/05064 8/1987 PCT Int'l Appl. .

*Primary Examiner*—Duane A. Reger
*Attorney, Agent, or Firm*—Calvin E. Glastetter

[57] ABSTRACT

A dampener for cushioning engagement forces of an impacting mechanism. An impacting mechanism has relatively movable members that can be releasably coupled together. The coupling engagement produces forces which tend to deform the coupling members. An impacting mechanism, having an actuator with a releasable coupling member is coupled to a relatively movable impact plunger, contains a dampener which compresses or deforms to cushion the coupling force. An impacting mechanism having a dampener for cushioning the forces during coupling engagement prevents the coupling members from being deformed.

15 Claims, 6 Drawing Sheets

DAMPENER FOR IMPACTING MECHANISM

TECHNICAL FIELD

This invention relates to a mechanical impacting mechanism used to impact a surface and more particularly to a dampener assembly for cushioning coupling engagement force between two members of the impacting mechanism.

BACKGROUND ART

A known impacting mechanism has a housing. An actuator plunger is mounted within the housing for axial movement with respect to the housing. A power plunger is mounted within the housing in parallel relation to the actuator plunger for movement with respect to the housing and the actuator plunger. The impacting mechanism has a latch which is fixed to the actuator plunger. With the actuator plunger in contact with a surface which is to be impacted the housing is moved toward the surface causing the latch to engage a fixed collar on the power plunger to releasably couple the actuator plunger to the power plunger. A problem associated with such impacting mechanism is that with the latch and collar both being fixed to respective plungers engagement forces are not cushioned when the plungers are coupled together. The engagement forces deform the latch and the collar.

The present invention is directed to overcome the problem as set forth above.

DISCLOSURE OF THE INVENTION

In one aspect of the present invention a dampener assembly for an impacting mechanism is provided. A guide structure is adapted to be connected to a movable manipulator. An impact plunger is movably supported relative to the guide structure. An actuator is parallel to the impact plunger and movably supported relative to the guide structure and the impact plunger. A means releasably couples the actuator and the impact plunger in response to the guide structure being moved toward the end surface of the actuator. A means cushions the coupling engagement between the impact plunger and the releasable coupling means.

An impacting mechanism having a means to cushion the coupling engagement between the impact plunger and the latch on the actuator reduces the engagement force to prevent damage to the coupling mechanism.

BEST MODE FOR CARRYING OUT THE INVENTION

Figure 1:
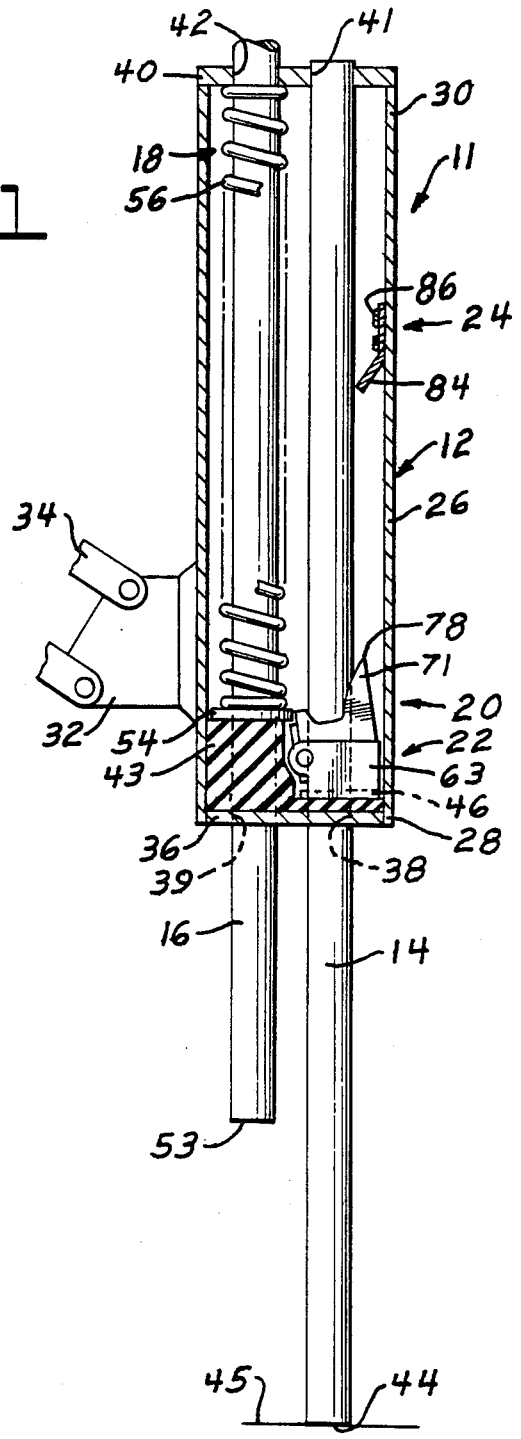
FIG. 1 is a sectional view showing the internal elements of an embodiment of the present invention.

As shown in FIG. 1 of the drawings, a dampener assembly 10 for an impacting mechanism 11 is shown. The impacting mechanism 11 includes a guide structure 12, an elongate actuator 14, an impact plunger 16, a resilient means 18, a releasable coupling means 20, a dampener means 22, and a releasing means 24.

The guide structure 12 includes a housing 26 having a first end portion 28 and a second end portion 30. A bracket 32 of suitable construction is fixedly attached to the housing 26, intermediate the first and second ends 28,30, and connects the housing 26 to a movable manipulator 34, such as a boom or suitable linkage of an industrial vehicle. A first end plate 36 is suitably fastened to the first end portion 28 of the housing 26. The end plate 36 has a first aperture 38 and a second aperture 39 adjacent the first aperture 38. A second end plate 40 is suitably fastened to the second end portion 30 of the housing and has a first aperture 41 aligned with the first aperture 38 of the first end plate 36 and a second aperture 42 adjacent the first aperture 41 and aligned with the second aperture 39 of the first end plate 36. A resilient bumper 43 is positioned within the first end of the housing 26 and is supported by the first end plate 36.

The actuator 14 slidably extends through the first aperture 38 of the first end plate 36 and the first aperture 41 of the second plate 40 and is moveable between an extended position and a retracted position. The actuator 14 has an end surface 44 adapted to contact a surface 45 to be impacted. A collar 46, has a hole 50 through which the actuator 14 extends, is fixedly attached to the actuator 14 and is positioned adjacent the resilient bumper 43 within the housing 26 when the actuator is in the extended position. The collar 46 has a stepped portion, adjacent the impact plunger 16, having a vertical surface 51 and a horizontal surface 52. The collar has a pair of spaced side steps 47 in the surface adjacent the bumper, as best shown in FIG. 3.

The impact plunger 16 slidably extends through the second aperture 39 of the first end plate 36 and the second aperture 42 of the second end plate 40 and is moveable between an extended position and a retracted position. In this specific embodiment the actuator and the impact plunger are positioned within the housing 26 in parallel and adjacent relationship to each other, however they could be positioned parallel and coaxial or concentric to each other as will be disclosed in an alternate embodiment. The impact plunger 16 has an end surface 53 adapted to impact the surface 45. A spring abutment and latching collar 54, has a hole 55 through which the impact plunger 16 extends, is fixedly attached to the impact plunger 16 and is positioned adjacent the resilient bumper 43 within the housing 26 when the impact plunger 16 is in the extended position.

The resilient means 18, in this specific embodiment a coil spring 56, encircles the impact plunger 16 and is positioned between and confined by the collar 54 of the impact plunger 16 and the second end plate 40 of the housing 26.

Figure 2:
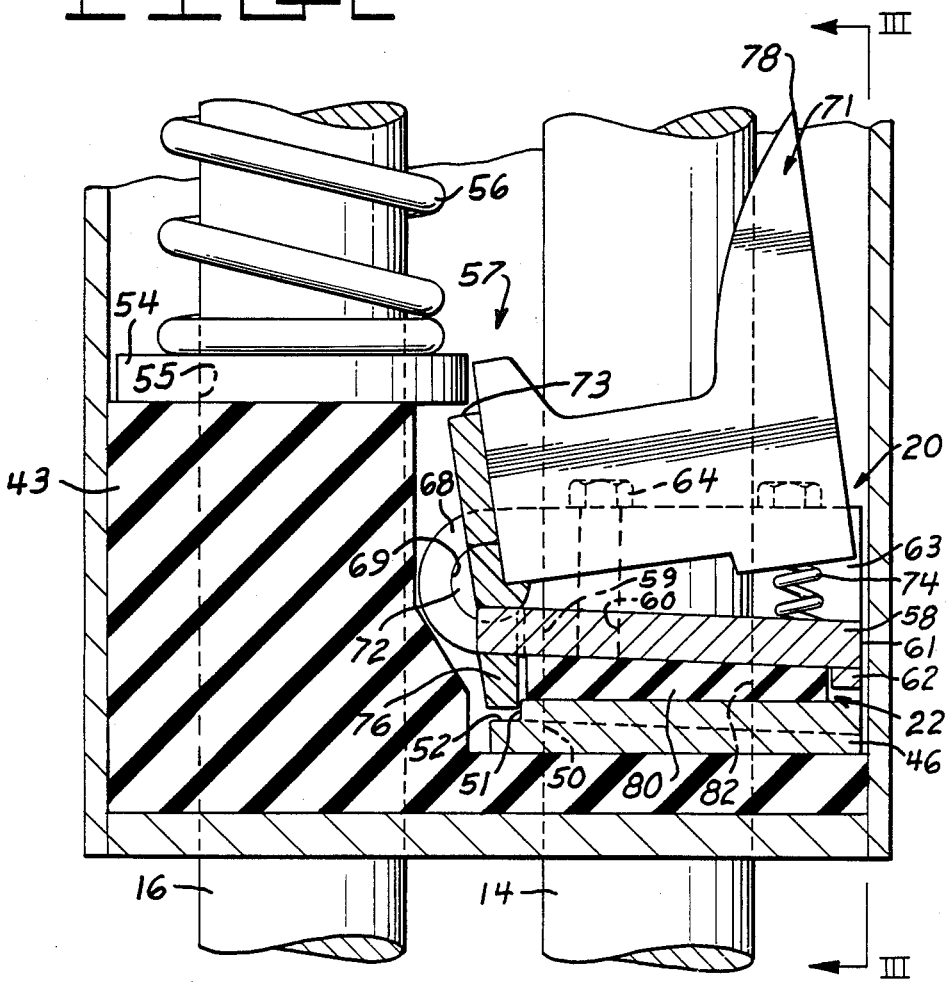
FIG. 2 is an enlarged view of a portion of the embodiment.
Figure 3:
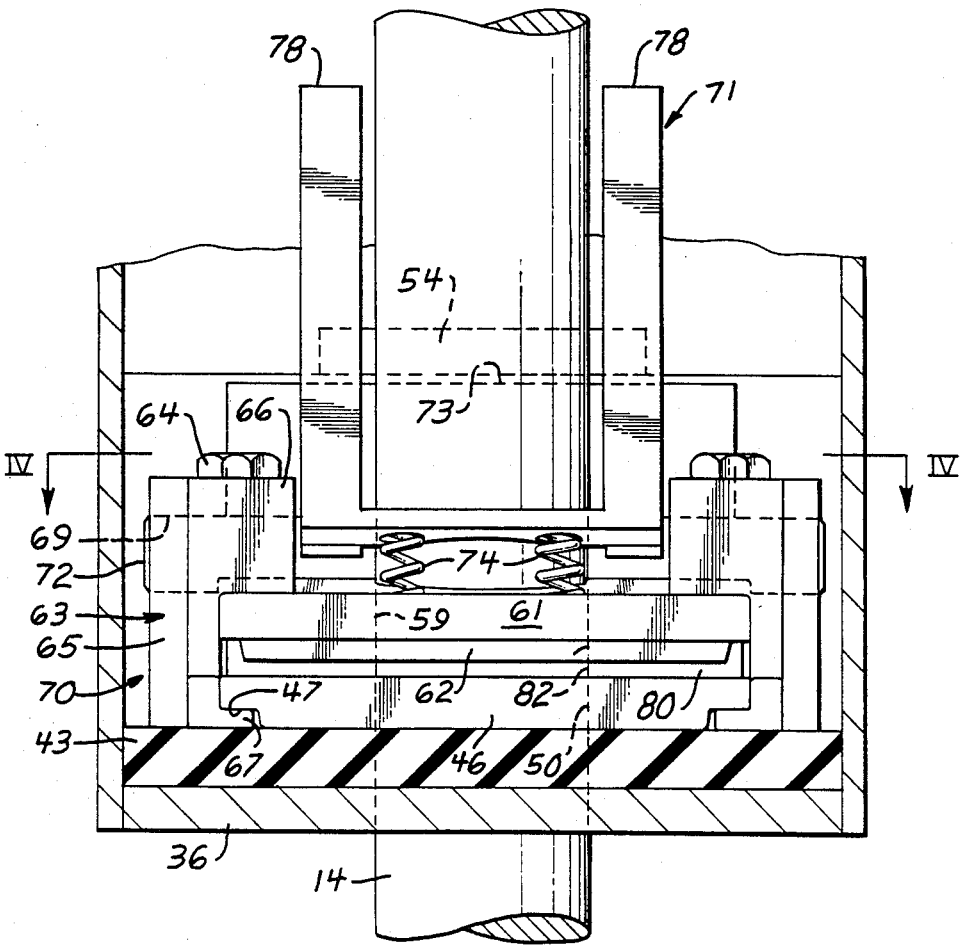
FIG. 3 is a sectional view taken along line III—III of FIG. 2.
Figure 4:
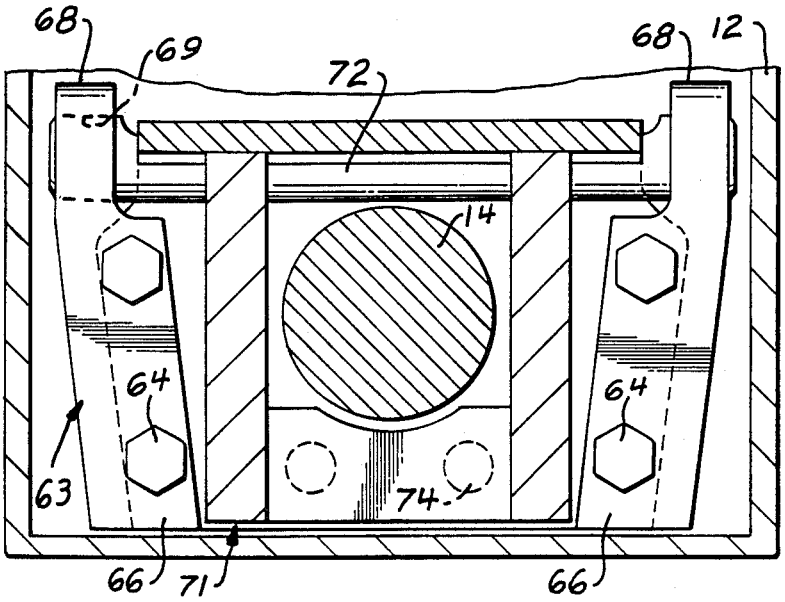
FIG. 4 is a sectional view taken along line IV—IV of FIG. 3.

As best shown in FIGS. 2, 3 and 4, the releasable coupling means 20 includes a latch assembly 57 on the actuator 14. The latch assembly 57 includes a mounting plate 58 slidably positioned on the actuator 14 adjacent the collar 46. The mounting plate 58 includes a hole 59, through which the actuator 14 extends, and a plurality of threaded holes, one of which is shown at 60. The diameter of the hole 59 is larger then the diameter of actuator 14 to allow for movement of the mounting plate 58. The mounting plate 58 also includes a vertical surface 61 adjacent the housing 26. A stop 62 is attached to the bottom surface of the mounting plate 58 adjacent to the vertical surface to limit movement of the mounting plate 58 toward the collar 46. The releasable coupling means 20 includes a pair of plates 63, each having a c-shaped cross section, attached to the top surface of the mounting plate 58 by a plurality of bolts 64, being threaded into the threaded holes 60. Each of the plates 63 includes a central body portion 65, a first flange 66 overlapping the mounting plate 58, and a second flange 67 overlapping and extending into the side step of the collar 46, as best shown in FIG. 3. Each of the plates 63 includes a mounting tab 68 having a bore 69, the bores 69 are aligned with each other. The plate 63 and overlapping flanges 66,67 provide a means 70 for limiting the movement of the mounting plate 58 away from the fixed collar 46. A latch 71 is pivotally mounted in the bores 69 of the mounting tabs 68 by a pin 72. The latch 71 has an engagement portion 73 adjacent the impact plunger 16 and is positioned for engagement with the spring abutment and latching collar 54. A pair of springs 74 are positioned between the latch 71 and the mounting plate 58 to urge the latch 71 in a counterclockwise direction as viewed in FIG. 2. A stop 76 which extends downwardly from the pin 72 of the latch 71 contacts the vertical surface 51 of the collar 46 to limit the counterclockwise pivotal movement of the latch 71. The stop 76 is positioned to contact the horizontal surface 52 of the collar 46 and the stop 62 is positioned to also contact the collar 46 to limit the movement of mounting plate 58 toward the fixed collar 46. The latch 71 also includes a releasing portion 78 adjacent the housing 26.

The dampener means 22 for cushioning coupling engagement includes, in the illustrated embodiment, a wedge shaped elastomeric pad 80 having a hole 82 through which the actuator 14 extends. The elastomeric pad 80 is positioned between the mounting plate 58 of the latch assembly 57 and the collar 46 of the actuator 14.

As shown in FIG. 1 the releasing means 24 includes an abutment member 84 removably attached within the housing 26 by a plurality of bolts 86 and positioned for engagement with the releasing portion 78 of the latch 71.

Figure 5:
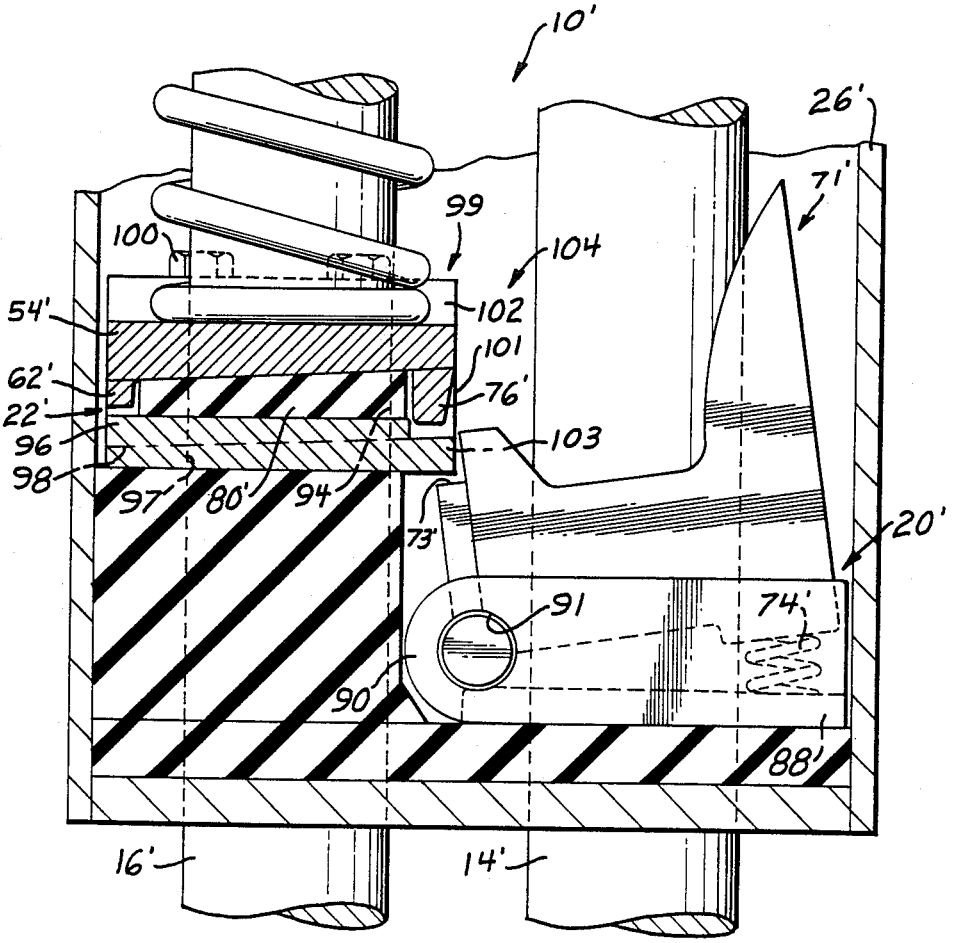
FIG. 5 is a view similar to FIG. 2 showing a first alternate embodiment.

In FIG. 5, a impacting mechanism of a first alternate embodiment is disclosed. The elements which are the same in both embodiments will be shown with a reference number having a prime.

A impacting mechanism 10' includes a dampener means 22' positioned on a impact plunger 16' to reduce the shock loading when the impact plunger 16' and a actuator 14' are coupled together.

The actuator 14' is movably supported by the housing 26'. A collar 88 is fixedly attached to the actuator 14' within the housing 26. The collar 88 includes a pair of spaced tabs 90 projecting therefrom, with each tab 90 having a bore 91 which is aligned with each other.

The impact plunger 16' is movably supported by the housing 26'. A spring abutment collar 54' is fixedly attached to the impact plunger 16' within the housing 26'. The dampener means 22' includes, in the illustrated embodiment, a wedge shaped elastomeric pad 80' positioned below and adjacent the fixed collar 54'. The elastomeric pad 80' has a hole 94 through which the impact plunger 16' extends. A collar 96, has a bore 97 through which the impact plunger 16' extends' is slidably positioned on the impact plunger 16' adjacent and below the elastomeric pad 80'. The bore 97 is larger then the diameter of the impact plunger 16, to allow the collar to move relative to the plunger 16'. The collar includes a pair of spaced side steps 98 similar to the steps 47 of the collar 46. The abutment collar 54' includes a pair of plates 99, only one shown, similar to the plates 63 of FIG. 3. The plates 99 have a c-shaped cross section and are removably attached to the fixed collar 54' by a plurality of bolts 100. The plates 99 each have a central body portion 101, a first flange 102 which overlaps the abutment collar 54', and a second flange 103 which overlaps and extends into step of the collar 96. The plates 99 and overlapping flanges 102,103 provide a means 104 for limiting the movement of the slidable collar 96 away from the fixed collar 54'.

A releasable coupling means 20' on the actuator 14' includes a latch 71' pivotally mounted in the bores 91 of the mounting tabs 90. The latch 71' has an engagement portion 73' positioned for engagement with the slidable collar 96. A pair of springs 74' are positioned between the latch 71' and the fixedly attached collar 88 for urging the latch 71' in a counterclockwise direction as viewed in FIG. 5.

Figure 6:
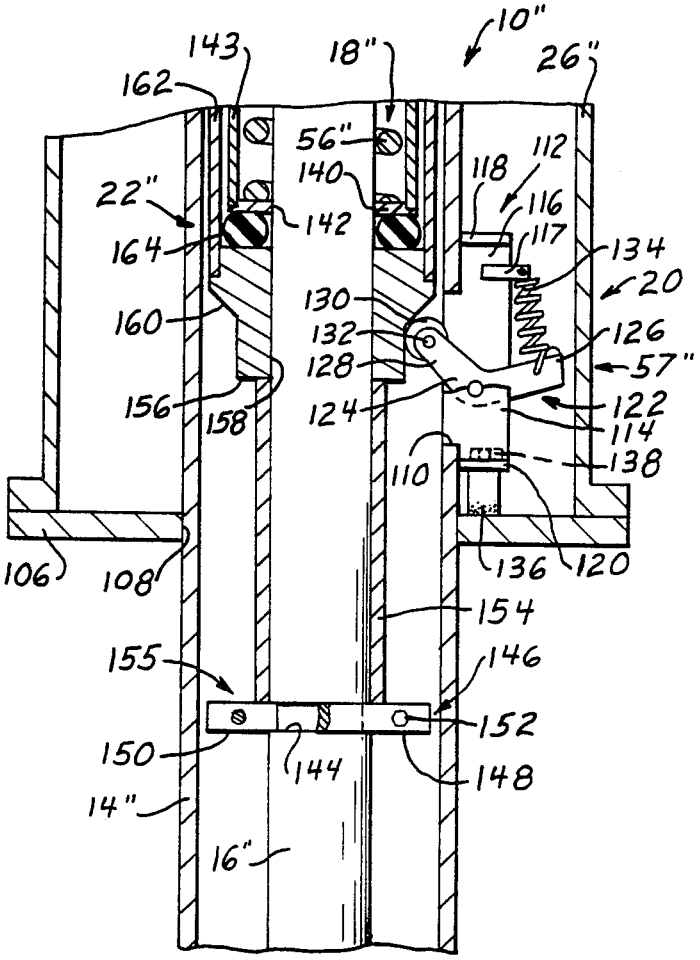
FIG. 6 is a view of a second alternate embodiment.

In FIG. 6, an impacting mechanism of a second alternate embodiment is disclosed. The elements which function the same in all embodiments will be shown with a reference number having a double prime. As shown in the drawing, an impacting mechanism 11'' includes a housing 26'' having an end plate 106 with a hole 108. A tubular actuator 14'' slidably extends through the hole 108 in the end plate 106, and is movable between an extended position and a retracted position. The tubular actuator 14'' includes a plurality of circumferentially equally spaced apertures, one of which is shown at 110, adjacent the end plate 106 within the housing 26'' when the actuator 14'' is in the extended position.

A releasable coupling means 20'' includes a plurality of latch assemblies, one of which is shown at 57'', positioned one in each of the apertures 110 of the tubular actuator 14''. Each latch assembly 57'' includes a mounting assembly 112 having a first side plate 114, and a second side plate 116 with a tang 117. The side plates 114, 116 are spaced apart and secured in the aperture 110. An upper plate 118 is secured to the upper end of the side plates 114, 116. A lower plate 120 is secured to the lower edge of the side plates 114, 116. A bellcrank 122 is pivotally attached between the side plates 114, 116. The bellcrank 122 has an inwardly projecting first arm portion 124 and an outwardly projecting second arm portion 126. The first arm portion 124 has a bifurcated end portion 128. A roller 130 is positioned within the bifurcated end portion 128 and rotatably connected thereto by a pin 132. A tension spring 134 is connected between the second arm portion 126 of the bellcrank 122 and the tang 117 of the second side plate 116 to pivot the bellcrank 122 counterclockwise. A plurality of resilient bumpers, one of which is shown at 136, are attached one under each of the lower plates 120 by a bolt 138. An impact plunger 16'' is telescopically disposed in parallel coaxial or concentric relation within the tubular actuator 14''. A spring abutment collar 140 having a hole 142 through which the impact plunger 16'' extends is fixedly attached to the impact plunger 16'' and is spaced upwardly from the apertures 110 in the tubular actuator 14'' when both the impact plunger 16'' and the actuator 14'' are in the extended position as shown. A tube 143 is attached to the collar 140 and extends upwardly. A resilient means 18'', in the specific embodiment a coil spring 56'', encircles the impact plunger 16'' and is positioned adjacent the collar 140 and enclosed and located by the tube 143. A groove 144 in the impact plunger 16" is spaced downwardly from the collar 140. A guide ring 146 is removably attached in the groove 144 of the impact plunger 16". The guide ring 146 includes a first member 148 and a second member 150 encircling and disposed in the groove 144 and maintained in position by bolts 152. An elongate sleeve 154 is positioned upwardly and abutts the guide ring 146 and extends upwardly encircling the impact plunger 16". A collar 156, having a hole 158 through which the impact plunger 16" extends, is slidably positioned on the impact plunger 16" above and abutts the sleeve 154 when the actuator 14" and the impactor 16" are not coupled together. The collar 156 has an annular surface 160 for engagement with the rollers 130, and a fixedly attached elongate sleeve 162 extends upwardly therefrom. The guide ring 146 and the sleeve 154 of the impact plunger 16" provides a means 155 for limiting the movement of the slidable collar 156 away from the abutment collar 140. The dampener means 22" includes an elastomeric pad or, in this specific embodiment, an elastomeric ring 164 positioned between the collar 156 and the spring abutment collar 140 and encircles the impact plunger 16".

Industrial Applicability

In the impacting process of the first embodiment, the movable manipulator 34 is used to move the impacting mechanism 11 toward the surface 45 which is to be impacted. The actuator 14 and the impact plunger 16 extend downwardly from the first end portion 28 of the guide structure 12 as shown in FIG. 1. In this position, the end surface 53 of the impact plunger 16 is spaced upwardly from the end surface 44 of the actuator 14. As the impacting mechanism 11 is moved downward, the end surface 44 of the actuator 14 contacts the surface 45 thereby stopping its downward movement. The spring 74 maintains the latch 71 in position to allow for the engagement portion 73 of latch 71 to engage the collar 54 on the impact plunger 16. As the guide structure 12 and the impact plunger 16 continue to be moved downward, the collar 54 contacts the engagement portion 73 and releasably couples the impact plunger 16 to the actuator 14, thereby stopping downward movement of the impact plunger 16. The elastomeric pad 80 of the dampener means 22 cushions the engagement force between the latch 71 and the collar 54. The elastomeric pad 80 compresses or deforms to allow the latch 71 and mounting plate 58 to move slightly toward the fixed collar 46. The elastomeric pad is wedge shaped because the engagement force produces a side loading which is higher directly below the contact point. The movement of the latch 71 and the plate 58 is stopped when the stops 62 and 76 contact the collar 46. The continued downward movement of the guide structure 12 relative to the impact plunger 16 and the actuator 14 compresses the spring 56 between the collar 54 and the second end plate 40 of the guide structure 12. When the guide structure 12 is moved downward a predetermined distance relative to the actuator 14 the abutment member 84 of the releasing means 24 engages the releasing portion 78 of the latch 71. Continued downward movement of the guide structure 12 and the abutment member 84 pivots the latch 71 outwardly around the pin 72 against the force of the spring 74, until the engagement portion 73 is disengaged from the collar 54 on the impact plunger 16. When the engagement portion 73 disengages from the collar 54, energy of the spring 56 is released and immediately drives the impact plunger 16 downward at a high rate of speed and high force to impact the surface 45. If the impact plunger 16 breaks through the surface 45 downward movement of the impact plunger 16 is stopped by cushioned engagement of the collar 54 with the resilient bumper 43.

The impacting mechanism 11 is then raised by lifting the guide structure 12. Upward movement of the guide structure 12 also raises the impact plunger due to the engagement between the bumper 43 and the collar 54. The gravitational weight of the actuator 14 causes it to remain in contact with the surface 45 during the initial movement of the guide structure 12 and the impact plunger 16. As the latch 71 becomes disengaged from the abutment means 84, the spring 74 pivots the latch 71 inwardly around the pin 72. Upward movement of the impact plunger 16 relative to the actuator 14 causes the latch 71 to contact the collar 54 and be pivoted clockwise or outwardly around the pin 72. After the latch 71 passes the collar 54, the spring 74 again pivots the latch 71 inwardly around the pin 72 to position the latch 71 for engagement with the collar 54. Continued upward movement of the guide structure 12 and impact plunger 16 eventually causes the collar 46 to engage the resilient bumper 43 thereby also raising the actuator 14 in unison with the guide structure 12 and the impact plunger 16. With the actuator 14 and the impact plunger 16 in position to be latched together, the impact process can be repeated to impact the surface 45 at adjacent locations.

In the impacting process of the first alternate embodiment, the dampener means 22' is associated with the collar 54' of the impact plunger 16'. The latch 71' is mounted on the collar 88 of the actuator. As the guide structure 12' and the impact plunger 16' move downward, the slidable collar 96 contacts the engagement portion 73' of the latch 71' and releasably couples the impact plunger 16' to the actuator 14'. The elastomeric pad 80' of the dampener means 22' cushions the engagement force between the latch 71' and the slidable collar 96 by compressing or deforming and allowing the slidable collar 96 to move slightly toward the spring abutment collar 54'.

In the impacting process of the second alternate embodiment, the dampener means 22" is associated with the collar 156 of the impact plunger 16". The plurality of latch assemblies 57" are mounted on the tubular actuator 14". As the impacting mechanism 11" is moved downward, the springs 134 pivot the bellcranks 122 inwardly to position the rollers 130 for engagement with the collar 156 on the impact plunger 16". As the housing 26" and the impact plunger 16" continue to be moved downward, the surface 160 of the collar 156 contacts the rollers 130 to releasably couple the impact plunger 16" to the tubular actuator 14", thereby stopping downward movement of the impact plunger 16". The resilient ring 164 of the dampener means 22" cushions the engagement force by compressing or deforming by allowing the collar 156 to move slightly upward relative to the sleeve 154. The continued downward movement of the housing 26" relative to the impact plunger 16" and the tubular actuator 14" compresses the spring 56". Downward movement of the housing 26" a predetermined distance relative to the tubular actuator 14" causes the releasing means (not shown) to contact the second arm portion 126 of the bellcranks 122. The continued downward movement of the housing 26" pivots the bellcranks outwardly to disengage the rollers 130 from the collar 156. When the rollers 130 disengage from the collar 156 energy of the spring 18" is released and immediately drives the impact plunger 16″ downward at a high rate of speed and high force.

An impacting mechanism 11 having a dampener means 22 positioned to cushion the coupling engagement between the latch and the collar reduces the engagement forces and prevents the parts from being deformed. In two of the embodiments the elastomeric pad 80 is wedged shaped because the engagement force produces a side loading which is high directly below the contact point. The thicker portion of the elastomeric pad compresses or deforms more than the opposite side and maintains proper alignment and contact between the collar 54 and the contact portion 73 of the latch 71. The second alternate embodiment has the plurality of circumferentially equally spaced latch assemblies 57″ which prevent side loading, therefore the cushioning means 22 is of constant thickness in the form of a flat elastomeric pad or an elastomeric ring as disclosed in the drawing.

Other aspects, objects and advantages of the invention can be obtained from a study of the drawings, disclosure, and the appended claims.

We claim:

1. A dampener assembly for an impacting mechanism, comprising:

a guide structure adapted to be connected to a movable manipulator;

an impact plunger movably supported relative to the guide structure, the impact plunger includes an abutment collar;

an actuator parallel to the impact plunger and movably supported relative to the guide structure having an end surface adapted to contact a surface to be impacted, the actuator including means for releasably coupling the actuator to the impact, plunger in response to the guide structure being moved toward the end surface of the actuator when the end surface of the actuator is in contact with the surface to be impacted; and means for cushioning the coupling engagement between the impact plunger and the releasable coupling means.

2. The dampener assembly of claim 1 wherein the means for cushioning includes an elastomeric pad connected with one of releasable coupling means of the actuator and the abutment collar of the impact plunger.

3. The dampener assembly of claim 2 wherein the actuator includes a collar and the elastomeric pad is positioned between the collar and the releasable coupling means on the actuator.

4. The dampener assembly of claim 3 wherein the releasable coupling means includes stops to limit the compression of the elastomeric pad.

5. The dampener assembly of claim 4 wherein the releasable coupling means includes a mounting plate attached to the actuator.

6. The dampener assembly of claim 5 wherein the releasable coupling means further includes means for limiting the movement of the mounting plate away from the collar.

7. The dampener assembly of claim 6 wherein the means for limiting includes a pair of plates each having a pair of flanges to contain the elastomeric pad and the mounting plate.

8. The dampener assembly of claim 2 wherein the impact plunger further includes a collar slidably positioned around the impact plunger and the elastomeric pad is positioned between the abutment collar and the slidable collar on the impact plunger.

9. The dampener assembly of claim 8 wherein the abutment collar includes stops to limit the compression of the elastomeric pad.

10. The dampener assembly of claim 9 wherein the abutment collar further includes means for limiting the movement of the slidable collar away from the fixed abutment collar.

11. The dampener assembly of claim 10 wherein the means for limiting includes a pair of plates each having a pair of flanges to contain the elastomeric pad and the slidable collar.

12. The dampener assembly of claim 1 wherein the means for cushioning includes an elastomeric ring connected with one of the releasable coupling means of the actuator and the abutment collar of the impact plunger.

13. The dampener assembly of claim 12 wherein the impact plunger includes a collar slidably positioned around the impact plunger and the elastomeric ring is positioned between the abutment collar and the slidable collar on the impact plunger.

14. The dampener assembly of claim 13 wherein the impact plunger includes means for limiting the movement of the slidable collar away from the abutment collar.

15. The dampener assembly of claim 14 wherein the means for limiting includes a guide ring and a elongate sleeve positioned on the impact plunger below the slidable collar.

* * * * *